US011359428B2

(12) United States Patent
Schärer et al.

(10) Patent No.: US 11,359,428 B2
(45) Date of Patent: Jun. 14, 2022

(54) DAMPER DEVICE

(71) Applicant: USM Holding AG, Muri bei Bern (CH)

(72) Inventors: Alexander Schärer, Muri bei Bern (CH); Thomas Dienes, Bern (CH); Kaspar Stöckli, Kiesen (CH)

(73) Assignee: USM U. SCHARER SOHNE AG, Munsingen (CH)

( * ) Notice: Subject to any disclaimer, the term of this patent is extended or adjusted under 35 U.S.C. 154(b) by 802 days.

(21) Appl. No.: 16/321,649

(22) PCT Filed: Apr. 19, 2017

(86) PCT No.: PCT/EP2017/059287
§ 371 (c)(1),
(2) Date: Jan. 29, 2019

(87) PCT Pub. No.: WO2018/024379
PCT Pub. Date: Feb. 8, 2018

(65) Prior Publication Data

US 2019/0309554 A1 Oct. 10, 2019

(30) Foreign Application Priority Data

Aug. 2, 2016 (EP) ..... 16182383

(51) Int. Cl.
*E05D 15/32* (2006.01)
*E05F 3/20* (2006.01)
(Continued)

(52) U.S. Cl.
CPC ..... *E05F 3/20* (2013.01); *E05D 3/06* (2013.01); *E05D 3/16* (2013.01); *E05F 1/12* (2013.01);
(Continued)

(58) Field of Classification Search
CPC ..... E05F 1/12; E05F 1/1276; E05F 1/1246; E05F 1/1253; E05F 1/1261; E05F 1/1058;
(Continued)

(56) References Cited

U.S. PATENT DOCUMENTS 2,120,685 A * 6/1938 Soss ..... E05D 3/16 16/288
5,664,290 A 9/1997 Scherrer
(Continued)

FOREIGN PATENT DOCUMENTS

CN 1840931 A 10/2006
CN 103924854 A 7/2014
(Continued)

*Primary Examiner* — Chuck Y Mah
(74) *Attorney, Agent, or Firm* — GableGotwals

(57) ABSTRACT

The invention relates to a device for pivotably holding a wing flap. The device comprises a flat four-bar linkage comprising two pivotably mounted pivoting arms and two pull arms fastened in parallel in an articulated manner to the pivoting arms, a fastening element for applying the wing flap being applied to the pull arms. The invention further comprises elastic means for damping the pivoting movement, which engage with the four-bar linkage, and a damper device for damping the pivoting movement in the region of two end positions, with a linear pressure damper and a first and a second transmission element. The pressure damper cooperates, on a first side of the pressure damper, via the first transmission element, with a first of the two pivoting arms in the region of a first of the two end positions. Furthermore, the pressure damper cooperates, on a second side of the pressure damper, via the second transmission element, with a second of the two pivoting arms in the region of a second of the two end positions. The invention further relates to a damper device for using in a device.

15 Claims, 3 Drawing Sheets

(51) Int. Cl.

| | |
|---|---|
| ***E05D 3/06*** | (2006.01) |
| ***E05F 1/12*** | (2006.01) |
| ***E05F 3/04*** | (2006.01) |
| ***E05D 3/16*** | (2006.01) |

(52) U.S. Cl.
CPC ..... *E05F 1/1276* (2013.01); *E05F 3/04* (2013.01); *E05Y 2900/20* (2013.01)

(58) Field of Classification Search
CPC ... E05F 1/1075; E05F 3/04; E05F 5/02; E05F 3/20; E05D 3/06; E05D 3/16; E05D 11/00; E05D 15/40; E05D 2003/163; E05Y 2201/10; E05Y 2201/256; E05Y 2201/21; E05Y 2201/264; E05Y 2201/47; E05Y 2201/492; E05Y 2900/20; E05Y 2900/202; E05Y 2600/10; E05Y 2600/41; A47B 2220/0072; Y10T 16/5383; Y10T 16/547; Y10T 16/5476
See application file for complete search history.

(56) References Cited

U.S. PATENT DOCUMENTS

| | | | | |
|---|---|---|---|---|
| 6,330,734 | B1 | 12/2001 | Cho | |
| 6,386,613 | B1 | 5/2002 | Vader | |
| 8,321,996 | B2 * | 12/2012 | Hirtsiefer | E05F 5/02 16/354 |
| 10,246,915 | B2 * | 4/2019 | Brunnmayr | E05D 15/32 |
| 10,370,884 | B2 * | 8/2019 | Stuke | E05F 5/006 |
| 10,494,846 | B2 * | 12/2019 | Schmid | E05D 3/16 |
| 10,590,688 | B2 * | 3/2020 | Salice | E05F 1/1058 |
| 2004/0177476 | A1 * | 9/2004 | Zetti | E05F 1/1253 16/287 |
| 2006/0220284 | A1 | 10/2006 | Holzapfel | |
| 2009/0072687 | A1 * | 3/2009 | Fitz | E05F 1/105 312/319.5 |
| 2015/0361709 | A1 * | 12/2015 | Stuke | E05F 5/006 16/352 |
| 2016/0153224 | A1 * | 6/2016 | Salice | E05F 5/02 16/65 |

FOREIGN PATENT DOCUMENTS

| | | | |
|---|---|---|---|
| DE | 102008010770 | A1 | 9/2009 |
| DE | 102011008252 | A1 | 7/2012 |
| DE | 102011002117 | A1 | 10/2012 |
| DE | 102012016938 | A1 | 9/2013 |
| EP | 0663504 | A1 | 1/1994 |
| EP | 0736659 | B1 | 4/2004 |
| EP | 1713996 | B1 | 1/2005 |
| EP | 1818491 | A2 | 8/2007 |
| EP | 2474786 | A2 | 7/2012 |
| GB | 1343821 | A | 1/1974 |
| JP | 2016008382 | A | 1/2016 |
| TW | 201233883 | A | 8/2012 |
| TW | 201420866 | A | 6/2014 |

* cited by examiner

DAMPER DEVICE

CROSS-REFERENCE TO RELATED APPLICATIONS

This application is the United States National Phase of Patent Application No. PCT/EP2017/059287 filed 19 Apr. 2017, which claims priority to European Application No. 16182383.6 filed 2 Aug. 2016 each of which is incorporated herein by reference.

BACKGROUND OF THE INVENTION

Technical Field

The invention relates to a device for pivotably holding a wing flap. The device comprises a flat four-bar linkage which has two pivotably mounted pivoting arms and two tension arms fastened in an articulated manner parallel to each other to the pivoting arms, wherein a fastening element for attaching the wing flap is attached to the tension arms. The device furthermore comprises resilient means for damping the pivoting movement, said resilient means acting on the four-bar linkage.

Prior Art

Fastening devices for mounting movable elements of items of furniture, such as, for example, front elements, doors or a wing flap, in a pivotable manner have long been known. Some fastening devices support the movable element in such a manner that the movable element is pivotable between open and closed about a horizontal axis. For this purpose, flat four-bar linkages are known which permit the movable element to be securely guided about the horizontal axis or permit the movable element to be lifted out of a frame in a desired manner before the pivoting. A fastening device with such a four-bar linkage is described, for example, by EP 0 736 659 81 B1 (USM Holding AG).

Furthermore, damper devices which damp the movable elements in a region of the end position both during the opening and during the closing are known for furniture systems. The damper devices permit comfortable handling of the movable element and reduce the production of noise.

EP 1 818 491 A2 (Hetal-Werke Franz Hettich GmbH & Co. KG) shows such a damper device for a furniture flap. The damping device comprises an articulated lever arrangement with two articulated levers which are each coupled firstly to a carcass-side fitting part and secondly to a furniture flap. During the closing of the furniture flap, a pivoting arm arranged on the articulated lever presses against an oil damper and compresses the latter, and therefore the movement of the furniture flap is damped.

DE 10 2008 010 770 A1 (Kesseböhmer Holding e. K.) discloses a further damper device. The fastening device described comprises a four joint system with two pivoting arms and a fastening piece which is attached to a front plate, and a fastening piece which is fastened to a furniture carcass. A front end of the one pivoting arm is designed as a curved cam which interacts with a slotted-guide part which is displaceable in a longitudinal guide, wherein the slotted-guide part is in interaction with a damper. During a pivoting-open and pivoting-closed movement of the front plate, the slotted guide part passes through a dead center position via a curved track control, and the damper can be effective both during the closing of the front plate but also during the opening of the front plate.

These known damper devices have the disadvantage that they require a large amount of space and also have a noticeable appearance.

SUMMARY OF THE INVENTION

It is the object of the invention to provide a device belonging to the technical field mentioned at the beginning for the pivotable holding of a wine flap, said device comprising a damper device and being able to be constructed compactly and being inconspicuous. Furthermore, the object consists in providing a damper device as a retrofitting element which can be inflamed on an already existing devices for pivotably holding a wing flap.

The achievement of the object is defined by the features of claim 1. According to the invention, the device for pivotably holding a wing flap comprises a damper device for damping the pivoting movement in the region of two end positions, with a linear pressure damper and a first and a second transmission element. The pressure damper interacts on a first side of the pressure damper via the first transmission element with a first of the two pivoting arms in the region of a first of the two end positions, and the pressure damper interacts on a second side of the pressure damper via the second transmission element with a second of the two pivoting arms in the region of a second of the two end positions.

A wing flap should be understood as meaning a single- or multi-part element which either opens up or closes an opening to a hollow space. The hollow space can be formed here by a box, a cupboard, a carcass, a storage box or another piece of furniture or housing. The wing flap can be pivotable here with respect to the piece of furniture or housing upward or downward about a substantially horizontal axis.

The linear pressure damper can be designed as a fluid damper, pneumatic damper or as a pressure damper with pure material damping. Use is preferably made of a fluid damper which comprises a cylinder housing and a piston rod which is guided in the cylinder housing and is movable relative to the cylinder housing. The details "first side of the pressure damper" and "second side of the pressure damper" relate to the damping axis. This means that the first side or the second side of the pressure damper is either at the axial end of the cylinder housing that faces away from the piston rod or is at the free axial end of the piston rod.

The wing flap is movable from a closed position into an open position and back along an adjustment path by means of a pivoting movement, wherein two end positions limit the adjustment path. In the closed position, the wing flap conceals the opening of the piece of furniture or of the housing. In the open position, the wing flap has been pivoted away from the opening, and therefore the interior of the piece of furniture or of the housing is accessible from the outside. The term used in the present description "in the closing direction" means that the wing flap is moved from the open position to the closed position. "In the opening direction" accordingly means that the wing flap is moved from the closed position toward the open position. Furthermore, "in the region of an end position" means that the wing flap is either located in a portion of the adjustment path upstream of the closed position or in a portion of the adjustment path upstream of the open position. It does not matter here how long said portion of the adjustment path is. The portion may comprise, for example, a third of the entire adjustment path or else only a tenth of the entire adjustment path.

In the present description, the detail "in the longitudinal direction" refers to the longitudinal axis of the device, and the detail "in the transverse direction" refers to the transverse axis of the device that is oriented at right angles to the longitudinal axis. The transverse axis runs here in the direction of the narrowest outer dimension of the device.

The device according to the invention has a damper device which is compact and can be fitted inconspicuously on the device for pivotably holding the wing flap. By means of the compact design of the damper device, the device takes up scarcely any more space than a device without a damper device. As a result, the internal volume of the piece of furniture or of the housing to which the wing flap is attached is virtually not reduced in size. By means of the compact and inconspicuous design of the damper device, the latter is not perceived as annoying. Furthermore, the damper device according to the invention permits efficient damping of the wing flap without an additional holding arm which takes up a large amount of space, as in the case of the damper devices known from the prior art.

In addition, the damper device according to the invention prevents the pivotable wing flap from coming in the region of the end positions into contact with the piece of furniture or the housing abruptly or impacting at too great a speed against an end position. As a result, damage can be avoided and wear phenomena of the components reduced. In comparison to a device for pivotably holding a wing flap without a damper device, the damper device according to the invention can thereby extend the surface life of the components. In addition, noises during closing or during opening of the wing flap can be greatly reduced by means of the damper device. The wing flap can be released in the region of the end positions and does not have to be carefully guided by hand to the end positions. This increases the operating comfort for the user.

The damper device according to the invention can be retrofitted without further adaptation onto an existing device for pivotably holding a wing flap, as described in EP 0 736 659 81 B1 (USM). The entire device for holding the wing flap thereby does not have to be replaced. This permits a cost-effective retrofitting of a damper device.

The resilient means acting on the four-bar linkage for damping the pivoting movement make it possible to ease the weight of the wing flap during opening and closing of the wing flap. This increases the operating comfort. The resilient means preferably interact here with the two tension arms of the four-bar linkage. The resilient means preferably comprise a spring element which is guided displaceably with its extendable part about an anchoring element.

The transmission elements between the pressure damper and the pivoting arms are advantageously movable in a translatory manner relative to each other. This permits a simple and compact construction of the damper device when a linear pressure damper is used. In addition, the transmission elements are preferably movable in a translatory manner relative to each other on the damping axis. As a result, the force transmitted by the transmission elements does not have to be deflected, and the linear pressure damper can interact directly with the transmission elements.

Alternatively thereto, the transmission elements can also be movable in a rotatory manner.

The transmission elements are preferably arranged in such a manner that, during the damping of the pivoting movement in the region of the two end positions, said transmission elements are moved toward each other counter to a force generated by the pressure damper. By contrast to an arrangement in which the transmission elements are moved away from each other during the damping, the arrangement according to the invention of the transmission elements permits a particularly space-saving construction.

As an alternative thereto, in the region of the two end positions, the transmission elements can also be moved away from each other counter to the force generated by the pressure damper.

The pressure damper is preferably a fluid damper which acts on one side and has spring resetting. This means that the pressure damper generates the force required for damping by means of compression. The pressure damper preferably comprises a cylinder housing and a linearly movable piston rod which is pushed into the cylinder housing during the compression. A fluid which is located in the cylinder housing damps the movement of the piston rod. By means of a mechanical spring, the piston rod is extended again when the force acting on the piston rod from the outside is smaller than the spring force. Such a pressure damper is capable of reliably damping shocks and impacts, does not require any maintenance and has a long service life.

As an alternative thereto, the pressure damper can also be designed as a pneumatic damper or as a damper with pure material damping.

The device for pivotably holding a wing flap preferably comprises a linkage frame on which the four bar linkage is mounted movably and to which the damper device is fastenable by means of a clip connection. The linkage frame affords the advantage that the four-bar linkage is mounted securely and stably.

A clip connection should be understood as meaning a latching, releasable connection. The clip connection comprises a first element with a projection or protruding lug and a second element with a ledge or a recess. When the elements are joined together, the projection of the first element engages in the recess of the second element. This permits a simple and secure form-fitting connection of the two elements. The lug can be formed either on the linkage frame or on an element of the damper device. The recess is formed on the opposite element. The latching of the clip connection into place is perceived acoustically and also haptically. It is therefore unambiguous during the mounting of the damper device when the damper device is fastened securely to the linkage housing. In addition, the clip connection permits mounting and removal of the damper device without tools. This simplifies the handling and permits a rapid and cost-effective installation of the damper device.

Alternatively thereto, the damper device can also be fastened to the linkage frame with a different connection, for example by means of a screw connection, rivet connection or clamping connection.

The transmission elements are preferably designed as arms. This permits a simple and effective interaction of the transmission elements or of the pressure damper via the transmission elements with the pivoting arms of the four-bar linkage. The arms have a longitudinal axis and a transverse axis at right angles to the longitudinal axis. The length along the longitudinal axis is preferably at least twice as long as the width of the arms along the transverse axis. The arms are preferably arranged in such a manner that their longitudinal axis is substantially at right angles to the damping axis. This permits a particularly efficient actuation of the pressure damper via the arms.

Alternatively thereto, the transmission elements can also be designed, for example, as circular or as square elements.

The arms preferably each have a supporting surface which comprises a concave portion which interacts with the respective pivoting arm in such a manner that, during the movement of the pivoting arms in the region of the end positions, the force generated by the pressure damper can be continuously transmitted to the pivoting arms. "Concave portion" means that the arms have a concave formation inward toward the longitudinal axis of the arms. The concave portion can be formed on one longitudinal side or on a plurality of longitudinal sides or the arms.

Since the force can be continuously transmitted to the pivoting arms, it is avoided that the damping starts, changes or stops suddenly. As a result, undesirable jerking or shocks in the region of the end positions can be avoided. This protects the components and permits a fluid sequence of movement of the pivoting movement of the wing flap. The region of the pivoting arms that interacts with the concave portion of the supporting surface of the arms preferably has a round shape. The interaction of the concave portion with the pivoting arm can thereby be improved further, and therefore the movement of the pivoting arms is damped particularly gently. In addition, a fluid and gentle transition from the movement region into the damped region of the end positions is made possible without damping.

As an alternative thereto, there is also the possibility that the arms do not have any concave portions. In this case, the arms can have, for example, convex formations or else can even have no specially shaped portions.

The damper device preferably comprises a damper housing in which the pressure damper and the transmission elements are mounted movably relative to the damper housing. The damper housing protects the pressure damper and the transmission elements against external actions and thus ensures the function thereof. In addition, the damper housing permits the pressure damper together with the transmission elements to be able to be mounted as a whole as a structural unit. This simplifies the handling and installation. In addition, the damper housing makes it possible to mount the pressure damper and the transmission elements movably relative to the damper housing.

Alternatively, the pressure damper and the transmission elements can also be fastened directly to the linkage frame without a damper housing.

The transmission elements advantageously each have a receiving space for the pressure damper, wherein a stop is formed in said receiving space. Via the respective stops, the first transmission element interacts with the first side of the pressure damper, and the second transmission element interacts with the second side of the pressure damper. The receiving space can be formed here as a depression, a cavity, a holder or an opening in the transmission element.

The receiving space is preferably designed in each case as a depression in the transmission elements, wherein the depression partially surrounds the cylinder housing of the pressure damper in a form-fitting manner. The axial boundary of the depression is designed as a stop. In this case, one transmission element has a stop for the free end of the piston rod and the other transmission element has a stop for the axial end of the cylinder housing that faces away from the piston rod. The pressure damper is thereby received by the transmission elements, and the transmission elements can interact securely with the pressure damper.

Alternatively, the transmission elements can also not have any stop space for the pressure damper. In this case, the pressure damper can interact, for example, with the surface of the transmission elements.

The transmission elements are preferably fastenable to each other by means of a clip connection. The latching and simply releasable clip connection permits rapid installation of the transmission elements without a tool. As a result, the pressure damper which is located in the receiving space of the transmission elements can be very easily exchanged when required. In addition, the clip connection can be designed in a highly space-saving mummer. By means of the clip connection, the transverse elements are preferably held in a form-fitting manner in each other in the transverse direction, but are displaceable relative to each other in the longitudinal direction. The clip connection therefore permits secure fastening in the transverse direction and simultaneously guidance of the transmission elements during a movement of the transmission elements in the longitudinal direction.

Alternatively thereto, there is also the possibility that the transmission elements are fastenable to each other, for example with a clamping connection or with a screw connection.

The damper housing preferably has a guide in which the transmission elements are guided by means of carry-along elements. The guide can comprise, for example, a groove, a slotted guide or a guide track. The carry-along elements of the transmission elements can be designed as pins, studs or as projections. By means of the guide, the transmission elements can be moved simply and securely along a certain adjustment path relative to the damper housing. In addition, the guide ensures that the transmission elements are optimally oriented in relation to the pivoting arms, and therefore the pressure damper can optimally damp the pivoting movement of the pivoting arms. A linear guide is preferably involved. If the transmission elements are movable in a translatory manner relative to each other, the linear guide ensures that the transmission elements are reliably displaceable with respect to each other over a predetermined adjustment path and cannot tilt or be blocked.

Alternatively thereto, the damper housing can also not have any guide. The transmission elements can then be mounted, for example, in a floating manner within the damper housing without a guide.

The pressure damper and the transmission elements are preferably movable freely between the two regions of the end positions relative to the damper housing without an action of force.

If the pressure damper and the transmission elements are not located in the region of the end positions, the transmission elements and the pressure damper accommodated therein can move freely without the action of an external force and without prestress. It is thereby prevented that the transmission elements together with the pressure damper are undesirably clamped in the housing or that the transmission elements and the pressure damper are blocked in the housing and thereby obstruct the pivoting movement of the pivoting arms.

Alternatively, the pressure damper and the transmission elements can also be fixedly clamped between the two end regions of the end positions or, for example, can be continuously prestressed by means of a pivoting arm such that they are not freely movable.

At least two devices according to the invention each having a damper device are advantageously used in a cupboard with a pivotable wing flap in order to hold and to damp the pivotable wing flap. A typical application is cupboards with doors which are pivoted from a vertical into a horizontal position during opening.

The invention furthermore comprises a damper device for use in a device for pivotably holding a wing flap. The damper device comprises a linear pressure damper and a first and a second transmission element. The pressure damper is imitable on a first side of the pressure damper in a first direction via the first transmission element, and the pressure damper is furthermore actuable on a second side of the pressure damper in a second direction opposed to the first direction via the second transmission element. The transmission elements are movable in a translatory manner relative to each other here.

The damper device can be used, for example, as a retrofitting element for a device for pivotably holding a wing flap. As a result, a damper device can be retrofitted in a simple manner in existing pieces of furniture having a pivotable flap.

The damper device preferably comprises a damper housing in which the pressure damper and the transmission elements are movable relative to the damper housing, and the transmission elements each have a receiving space for the pressure damper.

Further advantageous embodiments and combinations of features of the invention emerge from the detailed description below and the entirety of the patent claims.

BRIEF DESCRIPTION OF THE DRAWINGS

In the drawings used for explaining the exemplary embodiment.

In principle, identical parts are provided with the same reference signs in the figures.

WAYS FOR IMPLEMENTING THE INVENTION

Figure 1:
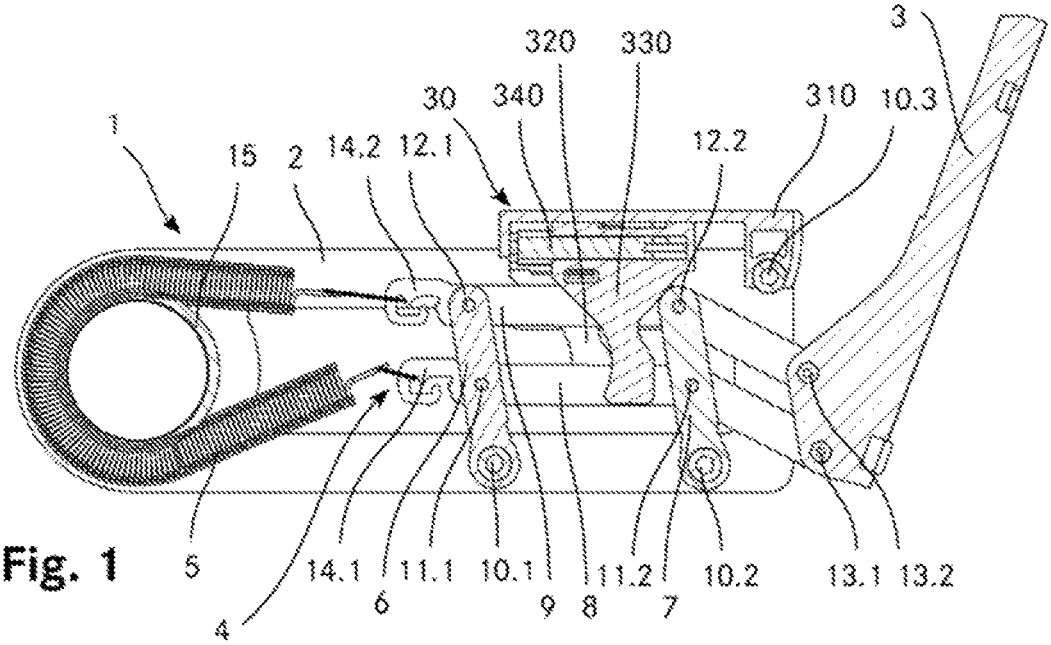
FIG. 1 show a sectional view of a vertically oriented section running parallel to the plane of symmetry of a device through a device according to the invention for pivotably holding a wing flap with a damper device, wherein the section runs through a second of two transmission elements, and wherein a four-bar linkage is in the region between a closed position and an open position.

FIG. 1 shows a sectional view of a vertically oriented section running parallel to the plane of symmetry of the device 1 through a device 1 according to the invention for pivotably holding a wing flap of a piece of furniture with a damper device. The section runs here through the second transmission element 330. In the position shown in FIG. 1, the four-bar linkage 4 is in a region between the closed position and the open position, wherein the four-bar linkage 4 is moved in the illustration from the open position into the closed position and is in the region shortly before the beginning of damping of the damper device.

The device 1 comprises a damper device 30 according to the invention, a linkage frame 2, a four-bar linkage 4, resilient means in the form of a tension spring 5 and a fastening element 3 for attaching a wing flap. The four-bar linkage 4 comprises two pivotably mounted pivoting arms 6, 7 arranged parallel to each other and two tension arms 8, 9 fastened in an articulated manner parallel to each other to the pivoting arms 6, 7.

The wing flap and the piece of furniture are not illustrated in the figures. The device 1 is mounted on the left and right of an opening of the piece of furniture. The wing flap which either closes or opens up the opening by swinging up or swinging down about a horizontally oriented axis is attached to the fastening element 3 of the device 1. Instead of the wing flap it is also possible, for example, for a cupboard door or a covering to be mounted. The piece of furniture can be, for example, office furniture, a small cupboard, a storage box, a filing cabinet or other optionally closable housing. It goes without saying that the wing flap is held on both sides by a device 1 with a damper device 30. On account of the symmetrical design of the four-bar linkage 4 of the device 1, the device 1 with the damper device 30 according to the invention can be mounted both on the left or right of the wing flap.

In the present description, the detail "at the rear" refers to regions or elements which lie away from the opening of the piece of furniture. Accordingly, the detail "at the front" refers to regions or elements which face the opening of the piece of furniture, i.e. face the wing flap. The detail "in the longitudinal direction" refers to the longitudinal axis of the linkage frame 2, and the detail "in the transverse direction" refers to the transverse axis of the linkage frame 2 that is oriented at right angles to the longitudinal axis.

The linkage frame 2 of the device 1 comprises two sheet-metal plates which are arranged parallel to each other and enclosure the four-bar linkage 4. The linkage frame 2 has a rectangular frame portion and an annular frame portion at the rear end of the linkage frame 2. The two parallel sheet-metal plates are connected to each other in the rectangular part by three rivet connections 10.1, 10.2, 10.3 and in the annular frame portion by a plastics ring 15 and are kept parallel at a defined distance.

The rivet connections 10.1 and 10.2, which are designed as continuous axes, on the linkage frame 2 serve at the same time as fastening axes and axes of rotation of the pivoting arms 6, 7. Each pivoting arm 6, 7 is formed by two webs which are spaced apart parallel to each other in the transverse direction and are connected to each other in the region of the rivet connection 10.1 and 10.2, respectively. As a result, the pivoting arms 6, 7 have a U-shaped configuration as viewed in the longitudinal direction. The tension arms 8, 9 are located between the webs of the pivoting arms 6, 7. The first tension arm 9 is fastened in an articulated manner to the pivotable end of the pivoting arms 6, 7 by means of bolts 12.1, 12.2. The second identical tension arm 8 is connected to the pivoting arms 6, 7 by means of bolts 11.1, 11.2. The bolts 11.1, 11.2 are each located approximately in the center between the rivet connections 10.1 and 10.2, respectively, and the bolts 12.1 and 12.2, respectively. The pivoting arms 6, 7 form a parallelogram of joints with the tension arms 8, 9. The fastening element 3 is held pivotably by means of bolts 13.1, 13.2 at a front end, on angled portions of the tension arms 8, 9. Hooks 14.1, 14.2 are formed at a rear end of the tension arms 8, 9. The two ends of the tension spring 5 can be hooked in place using said hooks. The tension spring 5 is guided around the plastics ring 8.

The four-bar linkage is overall of symmetrical construction with respect to the plane of movement of the parallelogram of joints. The tension arms 8, 9 and the tension spring lie centrally in the transverse direction in the plane of symmetry.

The damper device 30 according to the invention comprises a damper housing 310, a first transmission element 320 and a second transmission element 330, and also a pressure damper 340.

Figure 2:
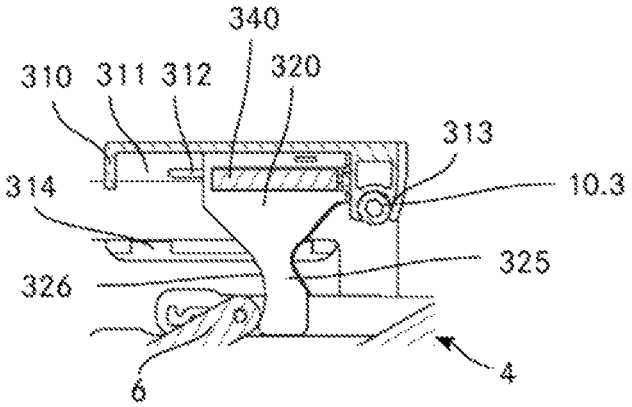
FIG. 2 shows a sectional view of a vertically oriented section running parallel to the plane of symmetry through the damper device, wherein the section, as seen in the transverse direction, runs between the first and the second transmission element, and wherein the four-bar linkage is in the open position.

FIG. 2 shows a sectional view of a vertically oriented section running parallel to the plane of symmetry through the damper device 30 according to the invention. The section runs here between the first and the second transmission elements 320, 330, as seen in the transverse direction. In the illustration of FIG. 2, the four-bar linkage 4 is in the open position.

The first transmission element 320 interacts with the first pivoting arms 6 and the second transmission element 330 interacts with the second pivoting arm 7. Since the pressure damper 340 is accommodated in the transmission elements 320, 330, the force generated by the pressure damper 340 for damping the pivoting movement can be transmitted via the transmission elements to the four-bar linkage 4, or the pivoting arms 6, 7 can interact with the pressure damper 340 via the transmission elements 320, 330. The damper housing 310 is fastened to the linkage frame 2 via a clip connection and movably supports the transmission elements 320, 330 and the pressure damper 340.

The damper housing 310 has a rectangular shape and is of U-shaped design in cross section. The damper housing 310 is located in an upper front region of the rectangular part of the linkage frame 2. The linkage frame 2 is surrounded here on both sides by two limbs 311 of the damper housing 310, which limbs are connected to each other at the upper end of the damper housing and thus form the U-shaped cross section. As is apparent in FIG. 2, the limbs 311 have, at their lower free ends, latching lugs 314 which, in the mounted state of the damper housing 310, engage in recesses in the linkage frame 2. Furthermore, the damper housing 310 comprises a bore 313 which runs in the transverse direction and has an axial slot in its casing. As a result, the damper housing 310 can be pushed with the bore 313 over the bolt 10.3 such that the bolt 10.3 is surrounded by the lateral surface of the bore 313. The damper housing 310 is fastened by the clip connection of the limbs 311 in a direction upward away from the four-bar linkage 4 and is securely fastened to the linkage frame 2 by means of the bore 313 by means of a form-fitting connection in the longitudinal direction. In the upper region, the two limbs 311 each have an elongated hole 312 in the longitudinal direction. The transmission elements 320, 330 which are displaceable relative to each other and relative to the damper housing 310 each have a carry-along element in the form of a stud (not illustrated in the figures), by means of which said transmission elements are guided in the elongated hole 312 in the damper housing 310 in the longitudinal direction. Said guide is described in detail further below.

Figure 3:
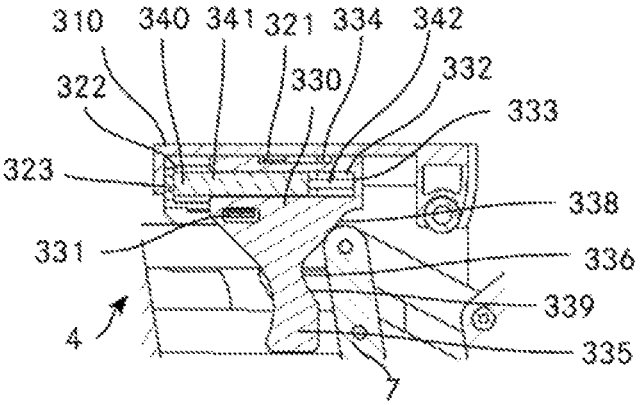
FIG. 3 shows a sectional view of a vertically oriented section running parallel to the plane of symmetry through the damper device, wherein the section runs through the second transmission element, and wherein the four-bar linkage is in the region between the closed position and the closed position.

It is apparent in FIG. 2 and FIG. 3 that the first and the second transmission element 320, 330 each have an upper rectangular region and in each case an arm 325, 335 protruding downward substantially at right angles to the longitudinal axis. In the illustration of FIG. 3, the four-bar linkage 4 is, as in FIG. 1, in a region between the closed position and the open position, wherein the four-bar linkage 4 is moved in the illustration from the open position into the closed position and is in the region shortly before the beginning of damping of the damper device. In the case of both transmission elements 320, 330, a receiving space in the form of a depression 322, 332 for the pressure damper 340 is in each case formed in the rectangular region on the respective inner side of the transmission element 320, 330 that faces the plane asymmetry. The depression 322, 332 can be seen particularly readily in FIG. 3 since, in this sectional view, the section runs through the second transmission element 330. The depressions 322, 332 have a semicircular shape in cross section. If the transmission elements 320, 330 are held with their inner sides against each other, a circular cavity is formed by the two depressions in cross section, in which the pressure damper 340 can be accommodated in a fitting manner.

The pressure damper 340 comprises a pressure damper housing 341 and a piston rod 342 which is movable linearly in the pressure damper housing 341. The pressure damper 340 is a fluid damper with a fluid located in the pressure damper housing 341, such as, for example, oil, an emulsion of water and oil, polyglycol solutions, silicone liquids or another synthetic liquid. Corresponding products are available commercially. When the piston rod 342 is retracted, the fluid is pressed by membranes, as a result of which a resistance arises, by means of which the movement is damped. A mechanical spring in the pressure damper housing 341 prestresses the piston rod 342, and therefore the piston rod 342 is pushed out of the pressure damper housing 341 when the force acting from the outside is smaller than the spring force of the spring.

The depression 322 of the first transmission element 320 is bounded in the axial direction at the rear end by means of a wall 323 which forms an axial stop. At the front end, the depression 322 is open outward in the axial direction. The depression 332 of the second transmission element 330 is open outward in the axial direction at the rear end and is bounded at the front end by means of a wall 333 which forms an axial stop. In the mounted state, the rear end of the pressure damper 340 that is remote from the piston rod 342 now lies against the wall 323 of the first transmission element 320. By contrast, the free end of the piston rod 342 lies against the wall 333 of the second transmission element 330.

The first and the second transmission elements 320, 330 are fastened to each other by means of a clip connection. For this purpose, the first transmission element 320 has, above the depression 322, a protruding lug 321, visible in FIG. 3, which engages in a recess 334, which is elongate in the longitudinal direction, in the second transmission element 330. The second transmission element 330 likewise has, below the depression 332, a protruding lug 331 which engages in a recess (not illustrated in the figures), which is elongate in the longitudinal direction, in the first transmission element 320. By means of the lugs 321, 331 and recesses, the transmission elements 320, 330 can be clipped together, and therefore the transmission elements 320, 330 are held together in the transverse direction by means of a form-fitting connection. However, the transmission elements 320, 330 are displaceable in a translatory manner relative to each other in the longitudinal direction by means of the recesses of elongate design. If the first transmission element 320 is displaced relative to the second transmission element 330, the wall 323 of the first transmission element 320 moves in the direction of the wall 333 of the second transmission element 330. By means of this movement, the piston rod is pushed into the pressure damper housing and the pressure damper is compressed.

While the transmission elements 320, 330 have the described depressions 322, 332 on their inner side, the transmission elements 320, 330 each have, as mentioned above, an outwardly protruding dome-shaped stud (not visible in the figures) on the outer side. The interconnected transmission elements 320, 330 are located between the limbs 311 of the damper housing and are each guided by means of their studs in the elongated holes 312 of the damper housing 310. As a result, the two transmission elements 320, 330 together with the pressure damper 340 accommodated in their depressions 322, 332 can be freely displaced in a translatory manner relative to the damper housing 310 along the longitudinal grooves 312. The transmission elements 320, 330 can additionally be displaced in a translatory manner relative to each other. The transmission elements 320, 330 are guided here by means of their lugs 321, 331 mutually engaging in the elongate recesses.

The arms 325, 335 of the transmission elements 320, 330 are in each case slightly offset in the transverse direction from the plane of symmetry of the device. As a result, the tension arms 8, 9 which lie centrally in the plane of symmetry lie between the arms 325, 335. The first transmission element 320 can interact via its arm 325 with the first pivoting arm 6 and the second transmission element 330 can interact via its arm 335 with the second pivoting arm 7. The arms 325, 335 each have, on their side facing forward and rearward, a supporting surface for the upper rounded ends of the pivoting arms 6, 7. Said supporting surfaces are shaped here as concave portions.

The concave portion of the rearwardly facing supporting surface of the arm 325 that interacts with the first pivoting arm 6 has a rounding 326, the radius of which is much larger than the radius of the rounded free end of the first pivoting arm 6. The rounding 326 here is oriented in such a manner that the rounded end of the pivoting arm 6 continuously interacts with the arm 325 of the transmission element 320 when the pivoting arm 6 is in contact with the arm 325.

The concave portion of the forwardly facing supporting surface of the arm 335 that interacts with the second pivoting arm 7 comprises a round partial portion 336, an upper rectilinear partial portion 338 and a lower rectilinear partial portion 339. The round partial portion 336 has a radius which approximately corresponds to the radius of the rounded free end of the second pivoting arm 7. The rectilinear partial portions 338, 339 lead from the outside inward toward the round partial portion 336. If the free end of the pivoting arm 7 comes into contact with the arm 335, the free end first of all moves along the upper rectilinear partial portion 338 of the arm 335 until it reaches the round partial portion 336 after a protrusion is overcome. The pivoting arm 7 continuously interacts with the arm 335 until the protrusion is overcome.

Figure 4:
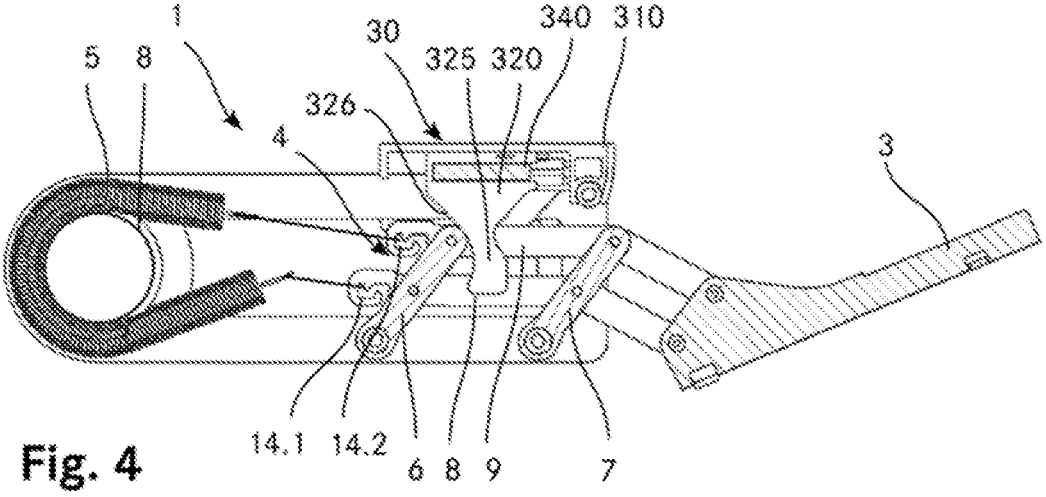
FIG. 4 shows a sectional view of a vertically oriented section running parallel to the plane of symmetry through the device with the damper device according to the invention, wherein the section, as seen in the transverse direction, runs between the first and the second transmission element, and wherein the four-bar linkage is in the region between the closed position and the open position.

FIG. 4 shows a sectional view of a vertically oriented section running parallel to the plane of symmetry through the device according to the invention with the damper device. The section runs here between the first and the second transmission element 320, 330, as seen in the transverse direction. In the illustration in FIG. 4, the four-bar linkage 4 is in the region between the closed position and the open position, wherein the four-bar linkage 4 is moved in the illustration from the closed position into the open position and is in the region shortly before the beginning of damping of the damper device.

If the wing flap is swung downward from the closed position in the opening direction, the fastening element 3 is pulled outward counter to the force of the tension spring 5. The four-bar linkage 4 predetermines here on which movement track the fastening element 3 is guided outward. If the fastening element 3 is brought into the horizontal position, the tension arms 8, 9 lie on each other and block a further movement.

When the wing flap is swung downward, the tension spring 5 is expanded in accordance with the travel distances covered by the hooks 14.1, 14.2 at the rear ends of the tension arms 8, 9. Since the tension spring 5 is displaceable with respect to the plastics ring 15, the length extension can easily be distributed over the entire length of the tension spring 5. The tension spring 5 is preferably a spiral spring. Since the spring force of a spiral spring increases as is known proportionally with respect to the length extension, the resetting torque acting on the fastening element 3 increases all the more, the stronger the fastening element 3 is brought with the wing flap into the horizontal in the opening direction.

On account of the geometrical dimensioning of the four-bar linkage 4, the fastening element 3 is pivoted about a geometrical pivot axis during opening. Said pivot axis is oriented horizontally and is located in a lower region before the opening of the piece of furniture.

In the closed position, the pivoting arms 6, 7 are located together with the pressure damper 340 in a rear region of the damper housing 310. If the wing flap is pivoted downward with the fastening element 3 in the opening direction, the upper end of the first pivoting arm 6 comes into contact with the arm 325 of the first transmission element 320. Since, during the pivoting movement in the opening direction, the first pivoting arm 6 is moved forward and downward, said pivoting arm via the arm 325 of the first transmission element 320 displaces the interconnected transmission elements 320, 330 together with the pressure damper 340 accommodated therein rectilinearly forward along the guide in the damper housing 340. During said displacement, the pressure damper 340 is not compressed and therefore does not generate any force on the pivoting arms 6, 7. If the wing flap together with the fastening element 3 is in the position illustrated in FIG. 4, the transmission elements 320, 330 which are pushed forward butt against a front end of the damper housing 310. If the wing flap together with the fastening element 3 is now moved further in the opening direction, the pivoting arms 6, 7 are inclined further forward. The upper end of the first pivoting arm 6 presses the first transmission element 320 here forward via the arm 325 thereof and thereby compresses the pressure damper 340. That is to say, the pressure damper 340 is compressed and the first transmission element 320 is displaced relative to the second transmission element 330 only when the transmission elements 320, 330 lie against the front end of the guide of the pressure housing and the first transmission element 320 is pushed further forward. A force generated by the compression of the pressure damper 340 acts on the first pivoting arm 6 and thus damps the pivoting movement of the four-bar linkage 4 and therefore the movement of the wing flap in the region of the end position before the open position. By means of the rounding 326 of the concave portion on the supporting surface of the arm 325, the force which is generated is continuously transmitted to the first pivoting arm 6. As a result, damping arising abruptly is avoided and the wing flap undergoes a continuous damping in the region of the end position.

Figure 5:
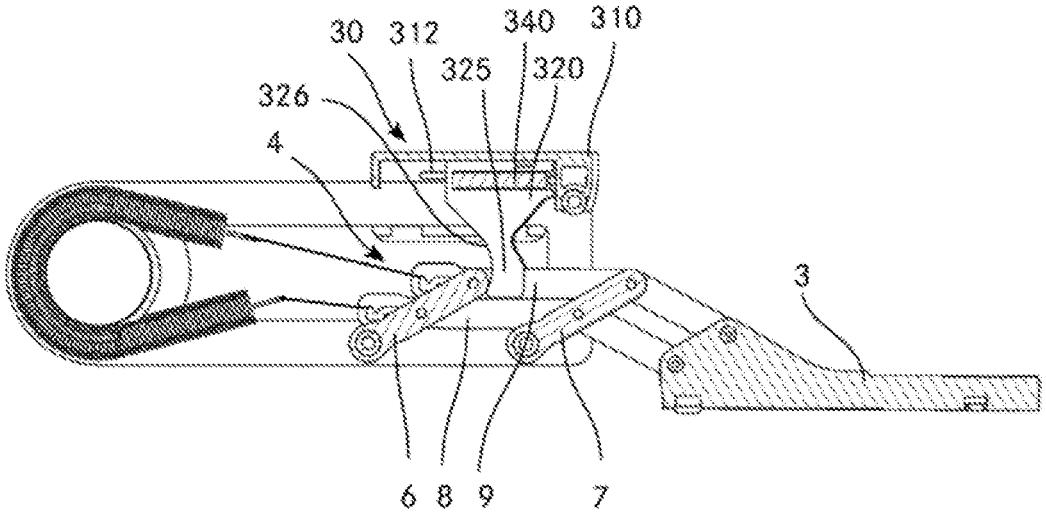
FIG. 5 shows a sectional view as in FIG. 4, wherein the four-bar linkage is in the open position.

FIG. 5 in turn shows a sectional view of a section in the plane of symmetry of the device. In the illustration in FIG. 5, the four-bar linkage 4 is in the open position. The pivoting arms 6, 7 are in the front most and lowermost pivoting position, and the upper end of the first pivoting arm 6 contacts the lower end of the rounding 326 of the supporting surface of the arm 325. In the open position, the first transmission element 320 is in its front most position in which, as seen in the transverse direction, the first and the second transmission elements 320, 330 lie virtually one above the other. However, the first transmission element 320 remains with the arm 325 which interacts with the pivoting arm 6 during opening 0.5 mm further to the rear, as seen in the longitudinal direction, than the second transmission element 330 with the arm 335 so that the pivoting arm 6 does not butt against the arm 335.

Figure 6:
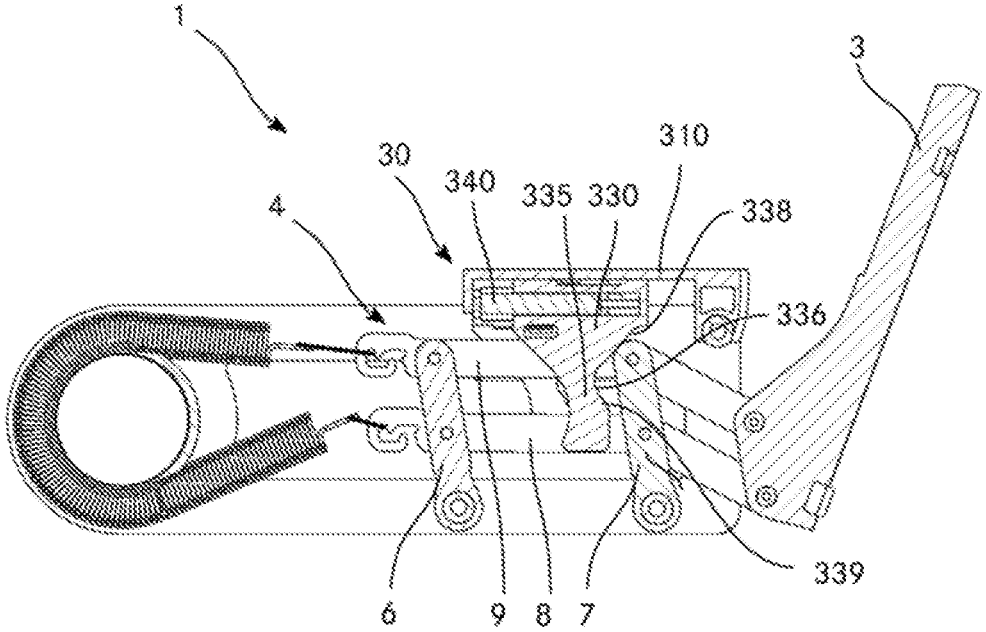
FIG. 6 shows a sectional view as in FIG. 1, wherein the four-bar linkage is in a region between the closed position and the open position.

FIG. 6 shows a sectional view of a vertically oriented section running parallel to the plane of symmetry, wherein the section runs through the second transmission element 330. In the view shown, the four-bar linkage 4 is between the open position and the closed position, wherein the four-bar linkage 4 is moved in the illustration from the open position into the closed position and is in the region shortly before the beginning of damping of the damper device. If the wing flap together with the fastening element 3 is pivoted upward in the closing direction, the second pivoting arm 7 firstly butts against the upper rectilinear partial portion 338 of the supporting surface of the arm 335 of the second transmission element 330, as illustrated in FIG. 6. The upper rounded end of the second pivoting arm 7 is moved here along the upper rectilinear partial portion 338 in the direction of the round partial portion 336.

If the wing flap together with the fastening element 3 is moved further in the closing direction, the transmission elements 320, 330 are pushed rearward along the guide in the damper housing 310 until they butt against the rear end of the damper housing 310. From this position, the second pivoting arm 7 presses the second transmission element 330 further rearward via the arm 335 and thereby compresses the pressure damper 340. In the process, the second transmission element 330 moves relative to the first transmission element 320. By means of the shape of the supporting surface with the rectilinear partial portion 338, the force generated by the pressure damper 340 is continuously transmitted to the pivoting arm 7. As a result, continuous damping is made possible in this region. As mentioned, the arm 335 has a protrusion which is located at a lower end of the rectilinear partial portion 338. Shortly before the end position, the upper end of the pivoting arm 7 overcomes said protrusion and drops into the round partial portion 336. As a result, after the protrusion is overcome, the pivoting arm 7 no longer lies against the arm 335, and therefore, for the complete closing no more damping takes place in said end region. This ensures that the four-bar linkage 4 is completely pulled by the tension spring 5 into the closed position.

Figure 7:
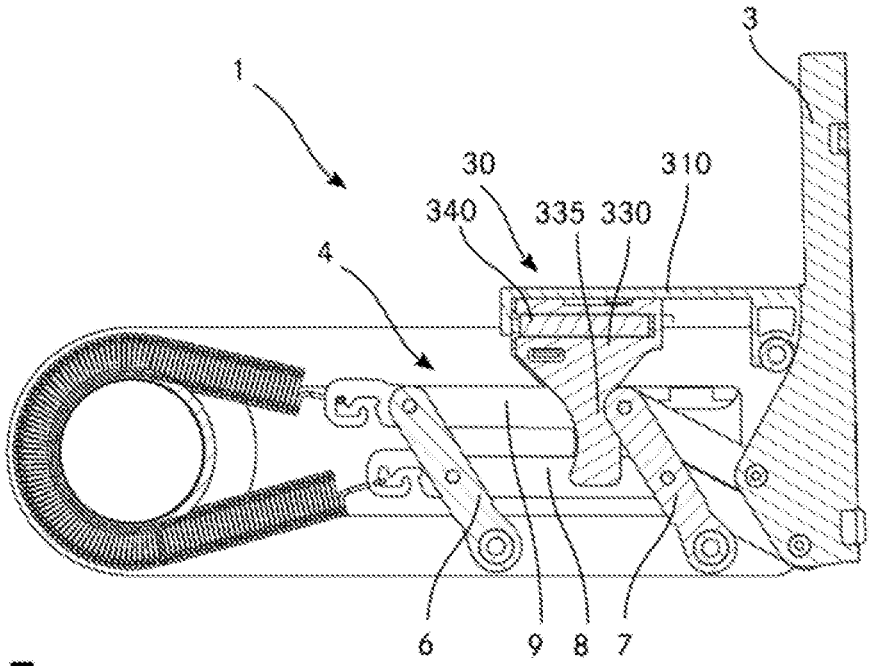
FIG. 7 shows a sectional view as in FIG. 6, wherein the four-bar linkage is in the closed position.

FIG. 7 shows a sectional view of the device when the four-bar linkage 4 is in the closed position. In said position, the upper end of the second pivoting arm 7 is in the round partial portion 336 of the supporting surface of the arm 335, wherein the second pivoting arm 7 also rests with its rearwardly facing side surface on the lower rectilinear partial portion 339. As a result, the second pivoting arm 7 is in a stable position. The pressure damper 340 is compressed and the first and the second transmission element 320, 330 lie virtually one above the other in the transverse direction. However, the second transmission element 130 remains with the arm 335, which interacts with the pivoting arm 7 during closing, 0.5 mm further forward, as seen in the longitudinal direction, than the first transmission element 320 with the arm 325 so that the pivoting arm 7 does not butt against the arm 325.

In addition, the damper device 30 according to the invention is usable as a retrofitting element for a device 1. By means of the clip connection, the damper housing 310 can be mounted rapidly and simply onto an already existing device 1.

The invention can be varied in diverse ways. The damper device 30 thus does not have to comprise two arms. Instead of arms, the transmission elements 320, 330 can also be designed in the form of studs or hooks which interact with the pivoting arms 6, 7. The damper device 30 also does not absolutely have to comprise a housing. The transmission elements 320, 330 and the pressure damper 340 can also be mounted movably directly on the linkage frame 2. The pressure damper 340 can be designed, for example, as an air damper, or the damping can take place by pure material damping without fluid. In addition, the transmission elements 320, 330 do not absolutely have to be freely movable between the end positions relative to the damper housing without the action of force. The transmission elements 320, 330 can thus be mounted rotatably, for example, at one point on the damper housing. The transmission elements 320, 330 also do not have to be fastened to each other by means of a clip connection. For example, they can be fastened to each other via a screw connection or clamping connection. In addition, they do not absolutely have to be in contact with each other. The damper housing 310 can also be connected to the linkage frame 2 in some other way, for example via a rivet connection or screw connection.

In summary, it can be established that an extremely compact and inconspicuous damper device for a device for pivotably holding a wing flap has been provided by the invention. In addition, the damper device is usable as a retrofitting element for an existing device for pivotably holding a wing flap.

The invention claimed is:

1. A device for pivotably holding a wing flap, said device comprising:

a) a flat four-bar linkage, which has two pivotably mounted pivoting arms and two tension arms fastened in an articulated manner parallel to each other to the pivoting arms, and wherein a fastening element for attaching the wing flap is attached to the two tension arms, b) resilient means for damping of a pivoting movement, said resilient means acting on the four-bar linkage, c) a damper device for damping the pivoting movement in a region of two end positions, with a linear pressure damper and a first and a second transmission element, wherein the pressure damper interacts on a first side of the pressure damper via the first transmission element with a first of the two pivoting arms in the region of a first of the two end positions, and wherein the pressure damper interacts on a second side of the pressure damper via the second transmission element with a second of the two pivoting arms in the region of a second of the two end positions.

2. The device as claimed in claim 1, wherein the first and second transmission elements are movable in a translatory manner relative to each other.

3. The device as claimed in claim 1, wherein the first and second transmission elements are arranged in such a manner that, during the damping of the pivoting movement in the region of the two end positions, said transmission elements are moved toward each other counter to a force generated by the pressure damper.

4. The device as claimed in that claim 1, wherein the pressure damper is a fluid damper which acts on one side and has spring resetting.

5. The device as claimed in claim 1, comprising a linkage frame, on which the four-bar linkage is mounted movably and to which the damper device is fastenable by means of a clip connection.

6. The device as claimed in claim 1, wherein the first and second transmission elements are designed as arms.

7. The device as claimed in claim 6, wherein the arms each have a supporting surface which comprises a concave portion which interacts with the respective pivoting arm in such a manner that, during movement of the pivoting arms in the region of the end positions, a force generated by the pressure damper can be continuously transmitted to the pivoting arms.

8. The device as claimed in claim 1, wherein the damper device comprises a damper housing in which the pressure damper and the transmission elements are mounted movably relative to a damper housing.

9. The device as claimed in claim 8, wherein the transmission elements each has a receiving space for the pressure damper, wherein a stop is formed in a receiving space, wherein, via the respective stops, the first transmission element interacts with the first side of the pressure damper and the second transmission element interacts with the second side of the pressure damper.

10. The device as claimed in claim 8, wherein the first and second transmission elements are fastenable to each other by means of a clip connection.

11. The device as claimed in claim 8, wherein the damper housing has a guide in which the first and second transmission elements are guided by means of carry-along elements.

12. The device as claimed in claim 8, wherein the pressure damper and the first and second transmission elements are movable freely between the two regions of the end positions relative to the damper housing without an action of force.

13. A cupboard with a pivotable wing flap which is held by means of at least two devices with a damper device as claimed in claim 1.

14. A damper device for use in a device as claimed in claim 1, wherein the damper device comprises a linear pressure damper and a first and a second transmission element, wherein the pressure damper is actuable on a first side of the pressure damper in a first direction via the first transmission element, and wherein the pressure damper is actuable on a second side of the pressure damper in a second direction opposed to the first direction via the second transmission element, wherein the transmission elements are movable in a translatory manner relative to each other.

15. The damper device as claimed in claim 14 wherein the damper device comprises a damper housing in which the pressure damper and the first and second transmission elements are movable relative to the damper housing, and the first and second transmission elements each have a receiving space for the pressure damper.

* * * * *